United States Patent [19]

Patton et al.

[11] Patent Number: 4,827,426

[45] Date of Patent: May 2, 1989

[54] DATA ACQUISITION AND PROCESSING SYSTEM FOR POST-MIX BEVERAGE DISPENSERS

[75] Inventors: Melissa F. Patton, Jonesboro; Kenneth G. Smazik, Marietta, both of Ga.

[73] Assignee: The Coca-Cola Company, Atlanta, Ga.

[21] Appl. No.: 50,488

[22] Filed: May 18, 1987

[51] Int. Cl.[4] ..... B67D 5/56; G07F 13/10

[52] U.S. Cl. ..... 364/479; 364/465; 141/174; 222/52; 222/129.4

[58] Field of Search ..... 364/479, 465, 510, 564, 364/200 MS File, 900 MS File; 141/95, 174, 198; 222/129.4, 129.3, 144.5, 14, 52; 219/333

[56] References Cited

U.S. PATENT DOCUMENTS

| | | | |
|---|---|---|---|
| Re. 29,450 | 10/1977 | Goldsby et al. | 364/900 |
| 3,823,846 | 8/1971 | Probst | 222/70 |
| 4,107,777 | 6/1977 | Pearson et al. | 364/465 |
| 4,162,028 | 7/1979 | Reichenberger | 222/144.5 |
| 4,236,553 | 7/1979 | Reichenberger | 141/198 |
| 4,237,536 | 10/1978 | Enelow et al. | 364/465 |
| 4,247,899 | 6/1979 | Schiller et al. | 364/465 |
| 4,276,999 | 7/1981 | Reichenberger | 364/479 |
| 4,360,128 | 11/1982 | Newmann | 219/333 |
| 4,412,292 | 2/1981 | Sedam et al. | 364/479 |
| 4,437,499 | 3/1984 | Devale | 141/95 |
| 4,487,333 | 2/1982 | Pounder et al. | 222/54 |
| 4,553,211 | 8/1983 | Kawasaki et al. | 364/479 |
| 4,562,547 | 3/1983 | Shauger | 364/484 |
| 4,566,287 | 1/1986 | Schmidt et al. | 141/174 |
| 4,572,255 | 7/1984 | Farmer et al. | 141/95 |
| 4,590,975 | 5/1986 | Creole Jr. | 141/174 |
| 4,597,506 | 7/1986 | Eglise et al. | 364/465 |
| 4,635,824 | 1/1987 | Gaunt et al. | 141/94 |

*Primary Examiner*—Jerry Smith
*Assistant Examiner*—Paul Gordon
*Attorney, Agent, or Firm*—Birch, Stewart, Kolasch & Birch

[57] ABSTRACT

A data acquisition and processing system for a post-mix drink dispenser which automatically determines and correlates the number, size and flavor of drinks poured from a plurality of valve assemblies to specific periods of time within a given day or week of a period of interest, and correlates the actual volume of syrup and water dispensed for the same period.

8 Claims, 8 Drawing Sheets

DATA ACQUISITION AND PROCESSING SYSTEM FOR POST-MIX BEVERAGE DISPENSERS

BACKGROUND OF THE INVENTION

The present invention relates to a data acquisition and processing system for a post-mix beverage dispenser. More specifically, the present invention relates to a system for collecting data from soft drink dispensing equipment such as utilized in fast food restaurants, and a processing system for correlating the data to specific times within a day or days.

Inventory control and analysis with respect to post-mix drink dispensers is an important part of the management of fast food restaurants. Some attempts have been made heretofore in post-mix systems to automatically sense and store information, such as drink size, flavor, and number of drinks. An example of such a system is described in U.S. Pat. No. 4,236,553 to Reichenberger.

The information obtained from the Reichenberger system is quite useful to a fast food restaurant manager for accounting purposes, and is also of interest to the beverage ingredient supplier. However, this information would be even more useful if it could be automatically correlated to a time of day, specific dates and specific periods of time within a given day or week. This time correlation would be useful in determining peak demand periods within normal business hours; and perhaps sales performances following special promotions or advertising by the ingredient supplier.

Another known system for acquiring and processing data with respect to post-mix beverage dispensers is described in U.S. Pat. No. 4,487,333 to Pounder, et al. In the Pounder system, a microprocessor outputs serial data representing the contents of its various internal registers. The information available in the registers is, for example, the total number of drinks dispensed by size for each valve assembly, the mixture ratios of syrup to water, the total syrup and water volumes, the syrup viscosity, portion sizes, syrup identification number, and syrup temperature. While the information generated and stored in the registers of the microprocessor of the Pounder system is useful, it would be even more useful if it could be correlated with respect to specific times of day, specific dates and specific periods of time within a given day or week.

Accordingly, a need in the art exists for an improved data acquisition and processing system for post-mix beverage dispensers.

SUMMARY OF THE INVENTION

Accordingly, it is a primary object of the present invention to provide a data acquisition and processing system for a post-mix drink dispenser which automatically correlates the number, size and flavor of drinks poured to specific periods of time within a given day or week of a period of interest, and correlates the actual volume of syrup and water dispensed for the same period.

It is a further object of the present invention to provide a data acquisition and processing system for a post-mix drink dispenser which may be easily connected to existing dispensing equipment and is compact enough to fit into spaces provided near or adjacent to the drink dispenser.

It is another object of the present invention to provide a data acquisition and processing system for a drink dispenser having a sufficient memory capacity to log data for extended periods of time.

It is still another object of the present invention to provide a data logging system for a post-mix drink dispenser which is easily calibrated and set up by a serviceman at the point of sale locations.

These and other objects of the present invention are fulfilled by providing in a beverage dispenser apparatus having a plurality of valve assemblies for dispensing respective flavors of beverages into containers of different sizes, said beverages including mixtures of syrup and water in predetermined proportions, a data acquisition and processing system for sensing and storing information with respect to beverages dispensed from each respective valve assembly, an improvement comprising:

(a) means for periodically counting at regular intervals the number of containers filled with beverage for each respective valve assembly, a filled container being defined as a drink;

(b) means for periodically determining at said regular intervals the volume of syrup and water dispensed by each respective valve assembly;

(c) clock means for continuosly generating time of day signals; and (d) means for correlating said time of day signals to said regular intervals; whereby the number of drinks, the volume of syrup and the volume of water dispensed for each respective valve assembly may be determined for selected times of day.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

The system of the present invention is designed for use with the dispensing system described in the aforementioned U.S. Pat. No. 4,487,333 to Pounder, et al., the details of which are incorporated herein by reference. The Pounder system will be referred to hereinafter as the "Smart Valve".

Figure 1:
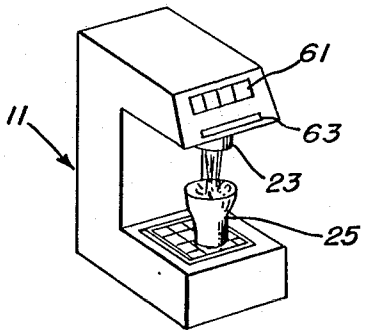
PRIOR ART FIG. 1
FIGS. 1 and 2 illustrate the data acquisition and processing system for a post-mix beverage dispenser described and illustrated with respect to the corresponding figure numbers in U.S. Pat. No. 4,487,333 to Pounder, et al.
Figure 2:
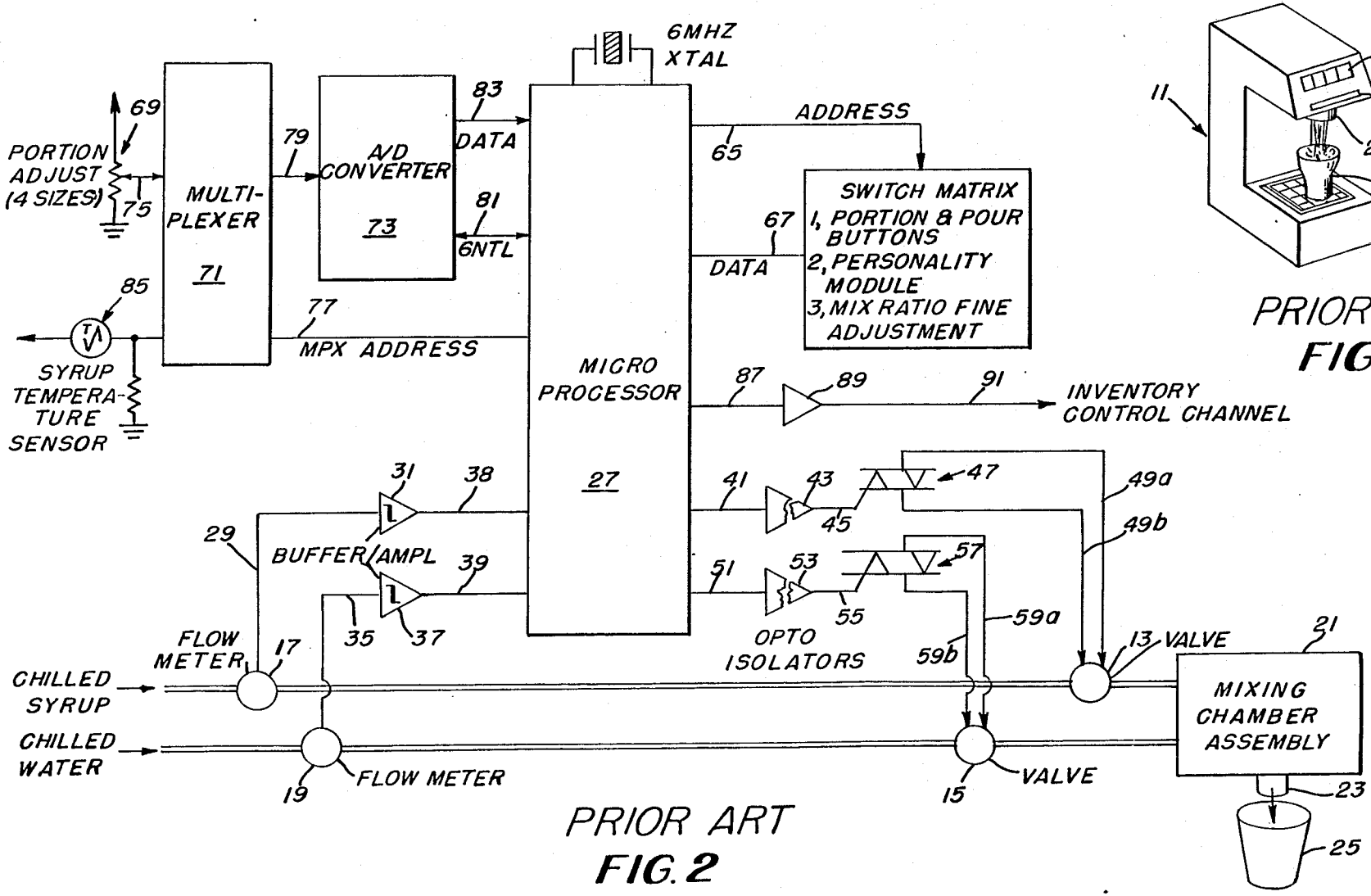
PRIOR ART FIG. 2

The "Smart Valve" system is designed with the purpose of dispensing post-mix drinks with accurate relative proportions of carbonated water and soft drink syrup. Separate syrup and water valves are controllably turned on and off, independently, at prescribed duty cycles, to provide a prescribed mix ratio, and syrup and water flow meters monitor the instantaneous flow rates of the water and syrup to minimize the effects of any pressure variations in the initial syrup and water supplies. The apparatus is conveniently modified for use with different soft drink syrups using a separate, removable personality module for each syrup, characterizing its prescribed mix ratio and its viscosity. Referring now to the drawings, and particularly to FIGS. 1 and 2, there is shown a single "Smart Valve" 11 embodying the features of the Pounder system for mixing together and dispensing a soft drink syrup and carbonated water in prescribed relative proportions. The apparatus includes a syrup valve 13 for turning on and off a supply of syrup and a water valve 15 for turning on and off a supply of water. The apparatus further includes a syrup flow meter 17 upstream of the syrup valve for measuring the syrup's flow rate, and a water flow meter 19 upstream of the water valve for measuring the water's flow rate. The syrup and water transmitted by the two valves are mixed together in a mixing chamber assembly 21 and dispensed through a nozzle 23 into a drinking cup 25. The "Smart Valve" also includes a microprocessor 27 for controllably opening and closing both the syrup valve 13 and the water valve 15 with prescribed duty cycles, such as the appartaus dispenses the soft drink syrup and water with a prescribed mix ratio. The two valves are cycled open at the same time, the syrup valve remaining open until it has dispensed about 0.15 ounces of syrup, and the water valve remaining open for whatever duration provides the prescribed mix ratio. This ratio is typically between about 3.5 to 1 and 6.0 to 1, depending on the particular syrup being dispensed. The peak flow rate of the water is higher than that for the syrup, to reduce the disparity between their respective duty cycles. As soon as both valves have dispensed the appropriate amounts of fluid, the cycle is repeated by again opening the water and syrup valves simultaneously. This cycling continues until a prescribed volume has been dispensed into the cup 25.

More particulary, and with reference to FIG. 2, both the syrup flow meter 17 and the water flow meter 19 are paddle wheel-type flow meters producing velocity signals in the form of pulse sequences having frequencies proportional to the flow rates of the fluids passing through them. The pulse sequence signal produced by the syrup flow meter is coupled over line 29 to a buffer-amplifier meter is coupled over line 29 to a buffer-amplifier 31 for conversion to appropriate logic levels, and in turn, over line 33 to the microprocessor 27. Similarly, the pulse sequence signal produced by the water flow meter is coupled over line 35 to a buffer amplifier 37, and in turn, over line 39 to the microprocessor 27.

The microprocessor 27 suitably processes the syrup and water pulse sequence signals received from the syrup and water flow meters 17 and 19, respectively, and generates syrup and valve drive signals for coupling to the respective syrup and water valves 13 and 15, to open and close them at appropriate times. The syrup drive signal is coupled over line 41 to an opto-isolator 43 and, in turn over line 45 to a triac 47, which outputs two corresponding drive signals for coupling over lines **49*a* and 49*b* to the syrup valve to open and close the valve correspondingly. Similarly, the water drive signal is coupled over line 51 to an opto-isolator 53 and, in turn, over line 55 to a water triac 57, which outputs two corresponding drive signals for coupling over line 59*a* and 59*b* to the water valve 15**, to open and close it correspondingly.

Referring again to FIG. 1, the "Smart Valve" further includes four push-button switches 61 for selecting one of four different drink portion sizes for the apparatus to dispense, such as small, medium, large, and extra-large. The apparatus also includes a pour/cancel push-button switch 63 that functions either to terminate dispensing if one of the four portion size buttons has been previously pushed, (i.e, cancel) or, if not, to dispense a drink for as long as it pushed (i.e., pour). The microprocessor monitors these various switches in a conventional fashion using address line 65 and data line 67. The microprocessor controllably opens and closes the syrup and water valves 13 and 15, respectively, in the manner described above, regardless of which one of these particular switches has been pushed. The only significant different in operation is in the number of cycles necessary to complete the dispensing of the selected drink. Associated with each of the four portion size switches 61 is a separate potentiometer, one of which is depicted at 69 in FIG. 2. These potentiometers are connected between a positive voltage and ground, and are used to adjust manually the size of the drink dispensed when the corresponding switch has been pushed. The microprocessor 27 periodically monitors the voltages present at the wipers of the four portion size potentiometers 69 in a conventional fashion using a multiplexer 71 and an analog-to-digital (A/D) converter 73. In particular, the potentiometers are connected by line 75 to four different input terminals of the multiplexer, and the microprocessor outputs appropriate address signals for coupling over lines 77 to the multiplexer to select a particular one. The voltage on the selected potentiometer is then coupled over lines 79 from the multiplexer to the A/D converter, which under control of four control microprocessor, converts the voltage to a corresponding 8-bit digital signal. The digital signal is in turn coupled over lines 83 from the A/D converter to the microprocessor.

The "Smart Valve" further includes a syrup temperature sensor 85 for providing an accurate indication of the actual temperature, and thus viscosity, of the syrup passing through the syrup flow meter 17. The microprocessor 27 periodically monitors the voltage output by the temperature sensor using the same multiplexer 71 and A/D converter 73, as are used for monitoring the four-portion adjust potentiometer 69.

After the "Smart Valve" 11 has completed its dispensing of a drink the microprocessor 27 outputs a serial data signal representing the contents of its various internal registers for use by an inventory control system such as the data acquisition and processing system of the present invention described hereinafter. These registers store data indicating, for example, the amount of syrup and water just dispensed, the temperature of the syrup, the syrup water and flow rates, the total drinks by size, the mixture ratios, and syrup identification number. The serial data signal is coupled over line 87 from the microprocessor to a buffer/amplifier 89, and output by the "Smart Valve" on line 91. The serial data output on line 91 is then fed to either the "Smart Valve" interface master unit 14 or one of the "Smart Valve" interface slave units 18 to be described in detail hereinafter with reference to FIGS. 3 and 4.

In a preferred embodiment, the microprocessor 27 of the "Smart Valve" is an INTEL 8049.

Figure 3:
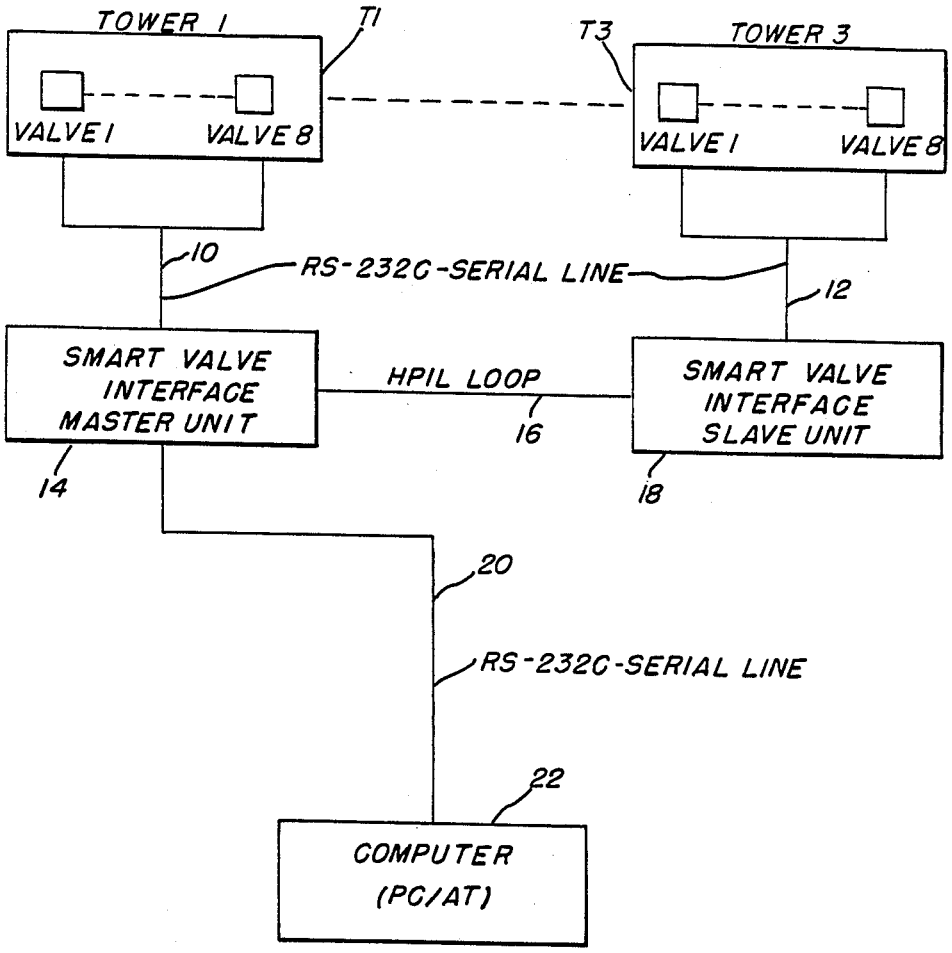
FIG. 3 is a block diagram illustrating the data acquisition and processing system of the present invention and the manner in which it is connected to a beverage dispenser containing the components of the post-mix beverage dispensing system of FIGS. 1 and 2.
Figure 4:
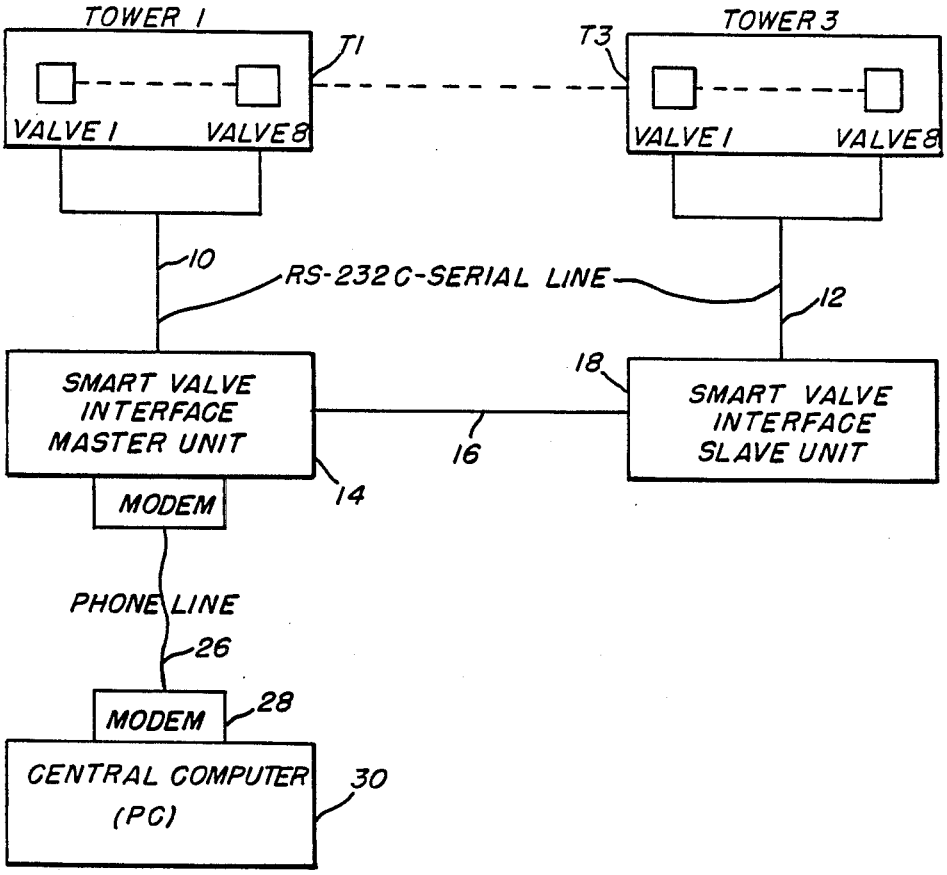
FIG. 4 is a block diagram illustrating essentially the same data acquisition and processing system of FIG. 3 with the addition of telephone modems and lines for transmitting the data acquired to remote locations via the telephone line.

Referring in detail to FIGS. 3 and 4, there is illustrated a post-mix beverage dispensing system such as might be used in a fast food restaurant. The system includes a plurality of beverage dispensing towers, three in the example shown, each of which includes eight "Smart Valves", such as the "Smart Valve" 11 described hereinbefore with respect to FIGS. 1 and 2. That is, each of the portions of the towers labeled "valve 1" ect. corresponds to one "Smart Valve" assembly 11.

The serial data output along line 91 from the microprocessor 27 of FIG. 2 is fed along line 10 or 12 which is a RS-232C-serial line. The data fed along line 10 proceeds to the "Smart Valve" interface master unit 14 and the data along other lines, such as 12, are fed to associated "Smart Valve" interface slave units such as 18, which are connected to the master unit 14 through a data loop which is preferably an HPIL data loop.

The master unit 14 includes an HP71B computer manufactured by Hewlett Packard Corporation which reads and processes the data received either from line 10 or HPIL loop line 16. In the embodiment of FIG. 3, the data from the master unit is transferrable along line 20 via another RS-232C-serial line to a computer 22, such as an IBM PC/AT. In the embodiment of FIG. 4, the processed data from the master unit 14 is transferred on demand to a central computer 30 which may be an IBM PC through modems 24 and 28 and telephone line 26. The manner in which the data is processed and transferred will be further described hereinafter with reference to the flow charts of the software illustrated in FIGS. 5 to 9.

In a typical fast food restaurant installation, the "Smart Valves" and associated data acquisition and processing system illustrated in FIGS. 3 and 4 transmits data from the "Smart Valves" to either a computer on sight (FIG. 3) or over a telephone line to a central location (FIG. 4). The information available from the system is the total drinks by size, mixture ratios, total syrup and water volumes, syrup viscosity, portion sizes, syrup identification number, and syrup temperature. In addition, from the syrup and water volumes and the total number of drinks by size, the yield per gallon of syrup can be computed.

The "Smart Valve" interface units 14 and 18 are capable of accepting the 5V logic level outputs of the INTEL 8049 microprocessor 27 built into each "Smart Valve" as the means of register data transfer from the valve to the interfaces. Input signal conditioning is provided if necessary for reliable data reception. The interfaces also are capable of collecting data from at least three dispensing towers T1 to T3 in a preferred embodiment containing a maximum of 8 "Smart Valves" each, i.e., 24 serial data input channels. However, it should be understood that additional towers and "Smart Valves" may be added as desired.

The interfaces are also capable of accepting data from each "Smart Valve" at a rate of 9600 BAUD and monitoring each of the 24 serial input channels for a synchronizing pulse that indicates that valid data is forthcoming. DIP switches can be provided to bypass any unused serial input channels and speed up execution, if processing time is a factor.

In addition to the 24 serial data input channels, a full duplex, asynchronous serial RS-423A/RS-232C port with "handshake" lines can be provided for bi-directional communications with the PC/AT computer 22. The port can have DIP switch selectable data rates of 1200, 2400, 4800 and 9600 BAUD. A standard female DB-25 connector can be provided on the interface enclosure to access the port.

The interfaces such as 14 and 18 accept registered data from each "Smart Valve" in packets and label each packet with code bytes that identify the particular valve and tower supplying the data. The registered data packets along with their identifying code bytes are memory mapped in the interfaces to allow random access to a valve/towers data by the PC/AT 22 or the PC 30 of FIG. 4.

Referring to FIG. 3, there are three possible modes of operation:

1. The PC/AT 22 may use "handshake" lines e.g. request-to-send and clear-to-send to initiate data transfer. Data packets are transmitted sequentially and still contain the valve/towers ID code bytes that are transferred first;

2. The PC/AT 22 requests a particular data packet by sending the appropriate valve/towers ID code bytes to the interface in bit serial format. The interface replies by first transmitting the valve and tower ID code bytes, followed by the register data packet; or 3. The interface does all data processing, so that the PC/AT can request yield only, drink totals, or any other register information data desired from the master unit, including the HP71B computer.

In summary, the data acquisition and processing system of the present invention transmits data from the "Smart Valves" in the respective towers of the system to remote locations such as to the computer 22 and computer 30. The information available is the total number of drinks dispensed by drink size, syrup and water volume, syrup temperature, syrup viscosity, portion size, mixture ratios, and syrup identification number. In a preferred embodiment, the data is collected at 15-minute time intervals by the master unit 14, including the HP71B computer and is dumped to the computers 22 or 30 every thirty minutes.

The information can be processed in a variety of ways, using the time stamp provided by a clock available in the HP71B computer, peak usage times can be determined. Marketing research can utilize this information to see how a new product is selling. Specific data on valve usage can also be collected to verify current specifications on the dispenser ratings. Since the "Smart Valve" is a ratio control device, the data will also verify that the "Smart Valve" is operating properly. Total number of drinks dispensed per gallon of syrup can be calculated to provide the fast food restaurant with information on yields per gallon of syrup. Customer preference by drink size and product can also be determined.

DESCRIPTION OF OPERATION

The operation of the data system of FIGS. 3 and 4 can be more readily understood by reference to the flow charts of FIGS. 5 to 9, which explain the system software for the HP71B computer. Since the system of FIG. 4 is substantially identical to the system of FIG. 3 with the exception of the modems and telephone line, the software will be described with respect to the more extensive system of FIG. 4 including the modems and central computer (PC) 30. However, it should be understood that the software for the operation of the system of FIG. 3 would be similar to the software illustrated in FIGS. 2 to 5 but would not include the "handle telephone communication" subroutine illustrated in FIG. 6.

Figure 5:
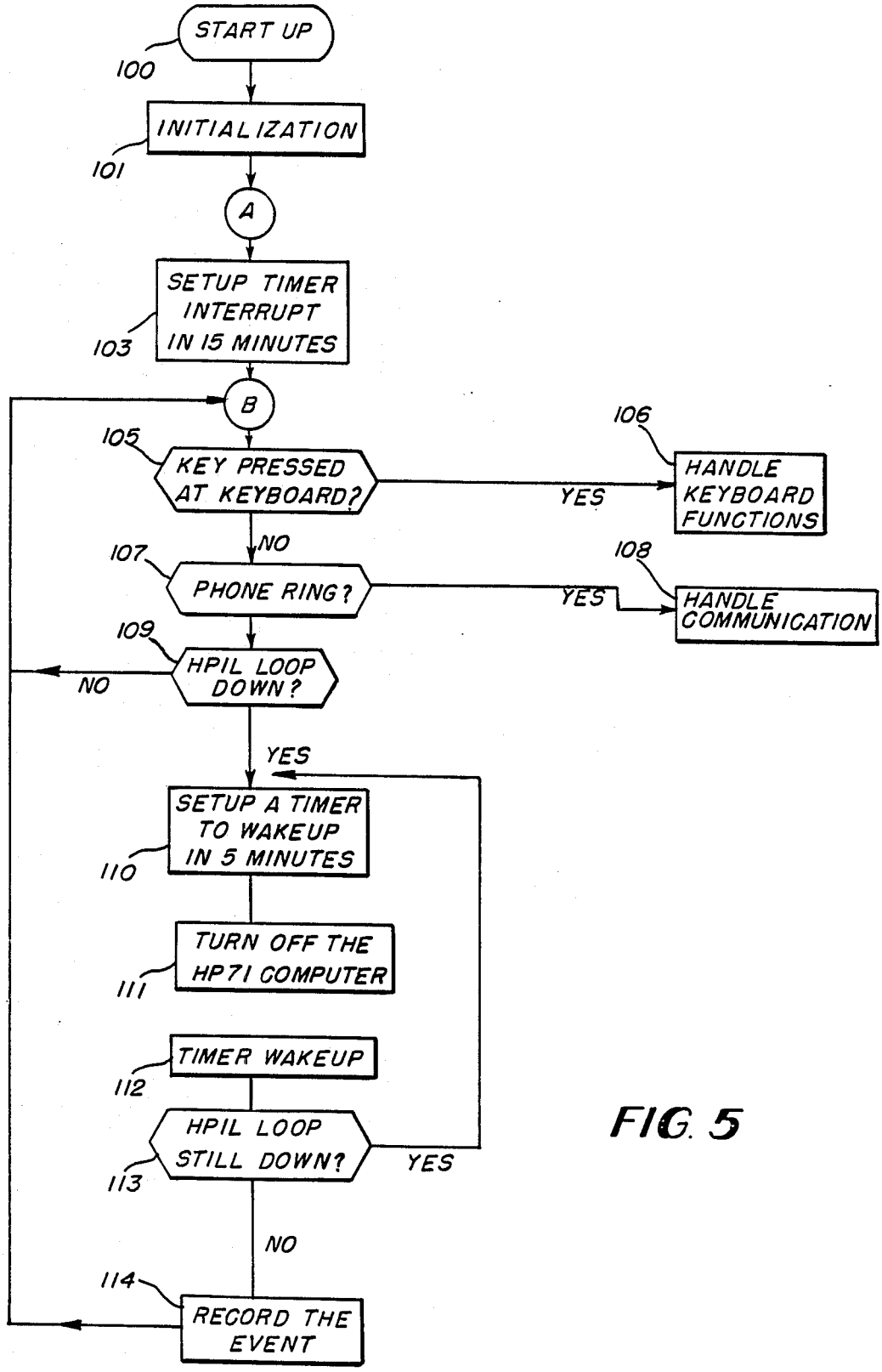
FIGS. 5 to 9 are flow charts of the software of the data acquisition and processing system of the present invention.
Figure 7:
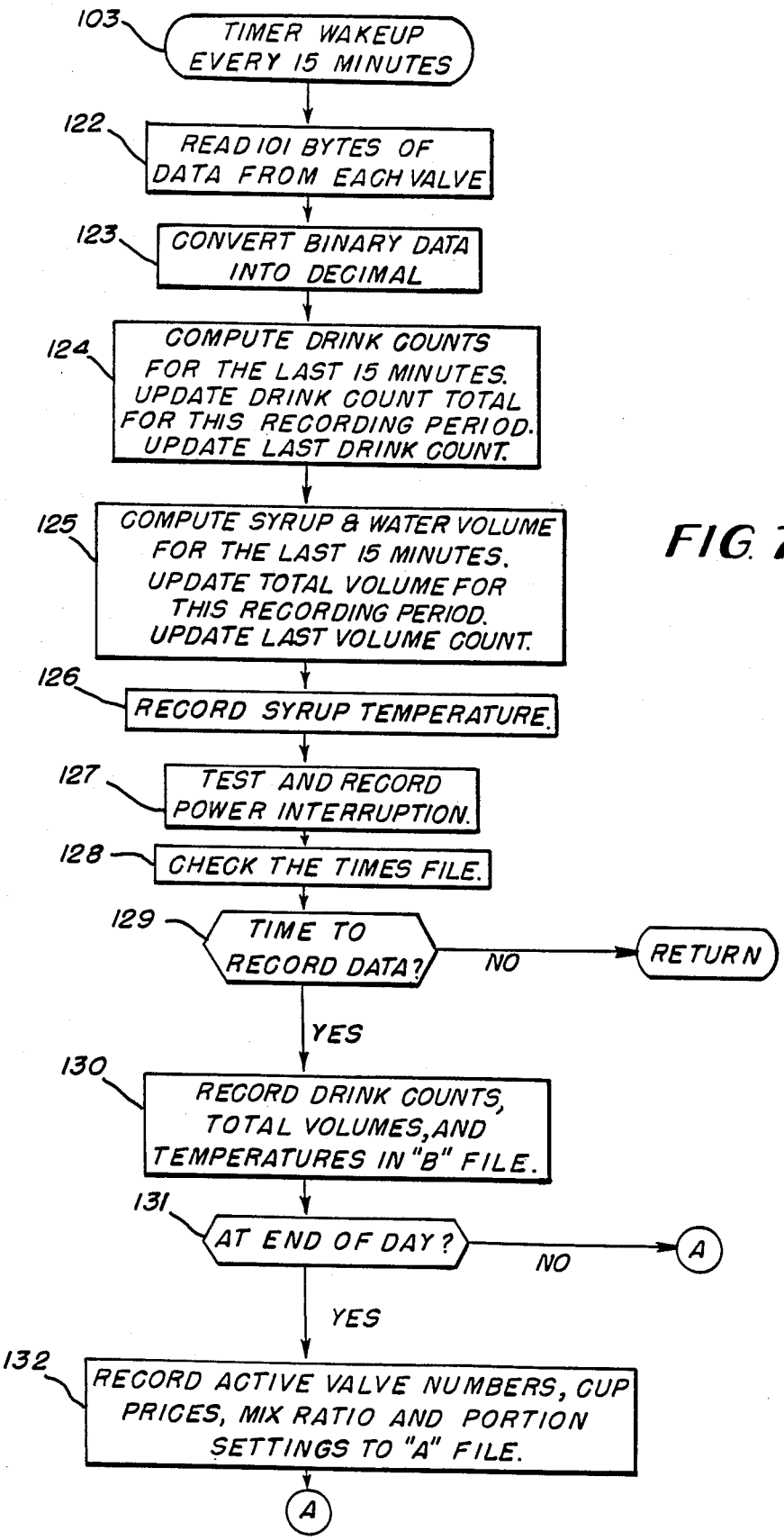
Figure 8:
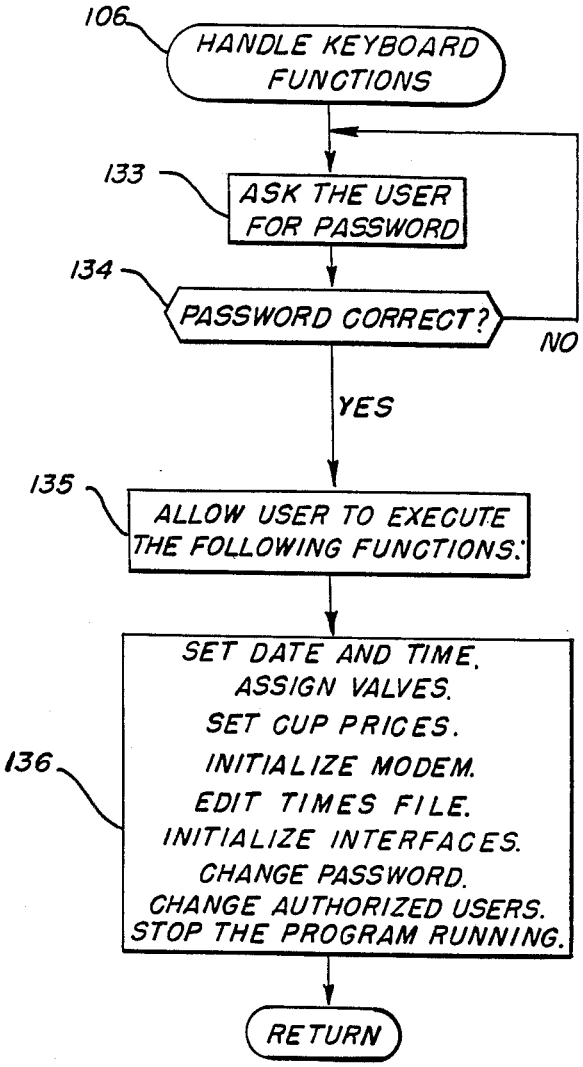
Figure 9:
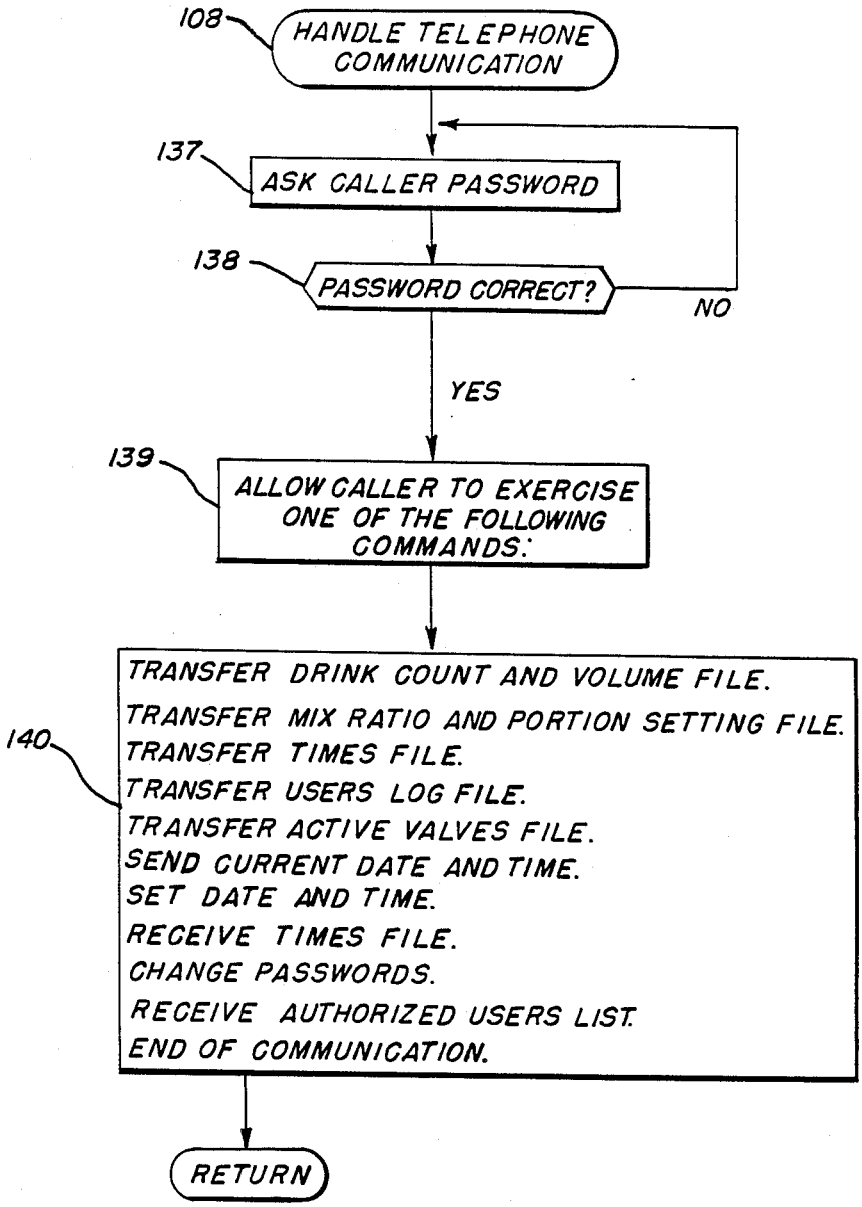

Referring to FIG. 5 there is depicted a flow chart illustrating the interaction of all subroutines illustrated in more detail in the flow charts of FIGS. 6 to 9. The flow chart of FIG. 5 begins with step 100 "start up" when the system is first turned on. The system is then initialized, step 101 by a sequence of steps illustrated in the subroutine of FIG. 6, and the program moves on to step A. The system is then instructed in step 100 to set up the timer interrupt in fifteen minute intervals (the subroutine of FIG. 7) and to read the data available from each of the respective valves and the respective towers of the dispensing system. The program then moves on to step B. Next the "key pressed at keyboard?" routine of step 105 is performed according to the subroutine illustrated in FIG. 8. The next step 107 in the main routine with respect to the system of FIG. 4 determines if there is a "phone ring?" along phone line 26 through modems 24 and 28. This subroutine is illustrated in FIG. 9. If there is no phone ring, the program then checks in step 109 to see if the HPIL loop is down. If the loop is not down, the system returns to step B. If the system is down, a timer within the computer is set up to wake up the system in five minutes by step 110 to allow any problems to clear. During that five-minute period, the HP71B computer is turned off at step 111 until the timer wakes up the HPIL loop at step 112. If the HPIL loop is still down, the flag 113 returns the program to the "set up a timer to wake up in five minutes" block. If the HPIL loop is not down, the program proceeds to step 114 to record the events which have been read from the respective valves.

Figure 6:
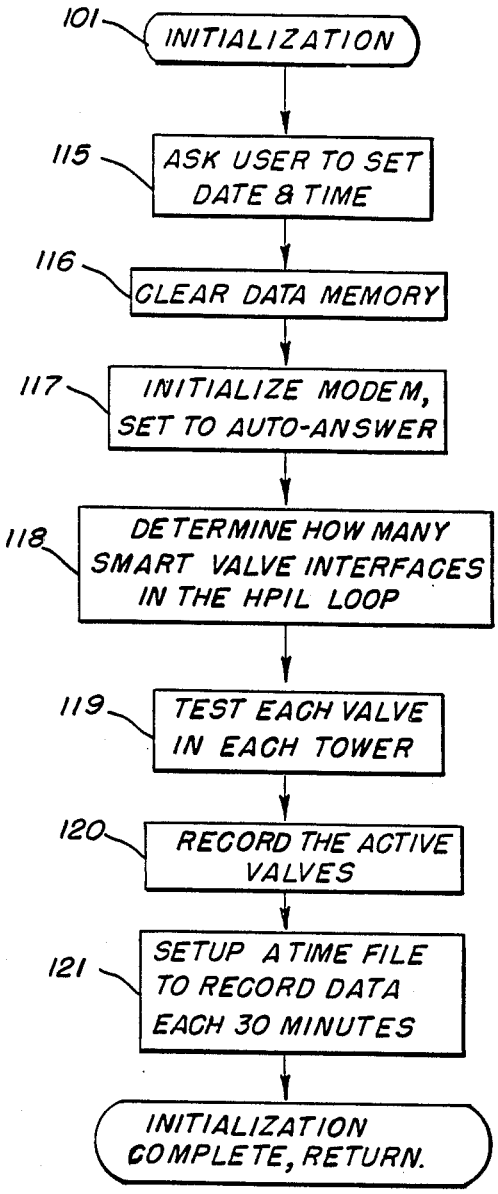

Referring to FIG. 6, there is illustrated the "initialization" subroutine 101. In the first step 115 of this routine, the computer asks the user to set a date and time. The data memory is then cleared by step 116, and if a modem is present, the modem is initialized and set to automatically answer the calls on phone line 26 in step 117. The system will then scan to determine how many smart valve interfaces 14 are in the system in step 118. The system then runs a test on each valve and each of the respective towers of the dispenser in step 119. The active valves of the system are then recorded in step 120. The next step 121 of initialization sets up a times file to record processed data every thirty minutes in comparator 30. It should be noted that data is only recorded every thirty minutes, even though it is read every fifteen minutes so that the memory in computers 22 and 30 is not overloaded. Initialization is then complete and the system returns to step A of the main routine of FIG. 5.

FIG. 7 illustrates the "timer wake" routine 103, which is the main data logging or data reading routine of the system software. In the first step 122 of this routine, the system reads the 101 bytes of data from each of the respective "Smart Valves" of each respective tower of the dispensing system. This data is then converted from binary data into decimal data in step 123. This data is then analyzed in step 124 to compute the drink counts for the last fifteen minutes of data collected. The drink counts are also updated to provide a drink count total for the recording period. Then the last drink count is updated. The data is then analyzed to compute actual syrup and water volumes from each respective "Smart Valve" for the last fifteen minute interval in step 125. The system then updates the total volume for this recording period and updates the last volume count. The data is then analyzed in step 126 to record syrup temperatures of each respective valve, and the system is tested for any power interruptions which might have occurred in step 127. The system then checks the times file in step 128 to determine if it is time to record the data which has been read, which occurs every thirty minutes as described above. If it is time to record data, the data is recorded in step 129 in terms of drink counts, total volumes and temperatures in a "B" file. However, if it is not time to record data, the system returns to step A of the main routine in FIG. 5. Following the recording of data at the end of any given day, the system will record the active valve numbers, cup prices, mix ratio, and portion settings of each respective valve and record the same in file "A", step 130. If it is not the end of the day, the system returns to step A of the main routine without performing the functions in the last block of FIG. 7.

The subroutine 106 of FIG. 8 "handle keyboard functions" is primarily provided for user security, and the first step 133 is to ask the user for the password. If the password is correct, the routine proceeds to an optional routine 135 which permits the user to execute the following functions 136:

set date and time
assign valves
set cup prices
initialize modem
edit times file
initialize interfaces
change password
change authorized users
stop the program running Normally the user would not need to execute these functions; but it might be desirable to do so, for example if an additional tower is added to an existing system or if any other changes have been made to the system since it was last in use.

The remaining subroutine 108 "handle telephone communication" of FIG. 9 relates only to the system illustrated in FIG. 4. In the first step 137 of this subroutine, the computer 30 asks for the caller password, and if the password is correct it allows the caller by flag 138 and step 139, to exercise one of the following commands 140:

transfer drink count in volume file
transfer mix ratio and portion setting file
transfer times file
transfer user's log file
transfer active valves file
send current date and time
set date and time
receive times file
change passwords
receive authorized user's list
end of communication The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a beverage dispenser apparatus having a plurality of valve assemblies for dispensing respective flavors of beverages in containers of different sizes, said beverages including mixtures of syrup and water in predetermined proportions, a data logging system for sensing and storing information with respect to beverages dispensed from each respective valve assembly, the improvement comprising:

(a) means for periodically counting at regular intervals the number of containers and determining the size of the containers filled with beverage for each respective valve assembly, a filled container being defined as a drink;

(b) means for periodically determining at said regular intervals the volume of syrup and water dispensed by each respective valve assembly;

(c) clock means for continuously generating time of day signals; and (d) means for correlating said time of day signals to said regular intervals; whereby the number and size of drinks and the volume of syrup and the volume of water dispensed for each respective valve assembly may be determined for selected times of day.

2. The system of claim 1 further including means for computing the number of drinks per gallon of syrup dispensed by each respective valve assembly.

3. The system of claim 1 further including means for determining the temperature of the syrup dispensed by each respective valve assembly.

4. The system of claim 1 further including means for transmitting data acquired via a telephone line to remote locations.

5. A method for use in a beverage dispenser apparatus having a plurality of valve assemblies for dispensing respective flavors of beverages into containers of different sizes, said beverages including mixtures of syrup and water in predetermined proportions, a data logging method for sensing and storing information with respect to beverages dispensed from each respective valve assembly, the improvement comprising the steps of:

(a) periodically counting at regular intervals the number of containers and determining the size of the containers filled with beverage for each respective valve assembly, a filled container being defined as a drink;

(b) periodically determining at said regular intervals the volume of syrup and water dispensed by each respective valve assembly;

(c) continuously generating time of day signals; and (d) correlating said time of day signals to said regular intervals; whereby the number and size of drinks and the volume of syrup and the volume of water dispensed for each respective valve assembly may be determined for selected times of day.

6. The method of claim 5 further including the step of computing the number of drinks per gallon of syrup dispensed.

7. The method of claim 5 further including the step of determining the temperature of the syrup dispensed by each respective valve assembly.

8. The method of claim 5 further including the step of transmitting data acquired via a telephone line to a remote location.

* * * * *